US009784015B2

(12) United States Patent
Chen

(10) Patent No.: US 9,784,015 B2
(45) Date of Patent: Oct. 10, 2017

(54) DUAL KEY LOCK CORE AND KEY LOCK CORE ASSEMBLY USING THE SAME

(71) Applicant: SINOXLOCK (KUNSHAN) CO., LTD., Zhangpu Town, Kunshan, Jiangsu (CN)

(72) Inventor: Mao-Yi Chen, Zhangpu Town (CN)

(73) Assignee: SINOXLOCK (KUNSHAN) CO., LTD, Kunshan (CN)

( * ) Notice: Subject to any disclaimer, the term of this patent is extended or adjusted under 35 U.S.C. 154(b) by 186 days.

(21) Appl. No.: 14/596,526

(22) Filed: Jan. 14, 2015

(65) Prior Publication Data

US 2015/0197962 A1 Jul. 16, 2015

Related U.S. Application Data

(60) Provisional application No. 61/927,158, filed on Jan. 14, 2014.

(51) Int. Cl.
*E05B 27/08* (2006.01)
*E05B 35/10* (2006.01)
*E05B 35/08* (2006.01)

(52) U.S. Cl.
CPC ..... *E05B 35/105* (2013.01); *E05B 35/08* (2013.01); *Y10T 70/7446* (2015.04); *Y10T 70/7486* (2015.04); *Y10T 70/7593* (2015.04)

(58) Field of Classification Search
CPC ..... E05B 35/105; E05B 35/08; E05B 35/10; Y10T 70/7486; Y10T 70/7593; Y10T 70/7621; Y10T 70/7446
USPC ..... 70/337–343, 491, 496, 403, 404, 420, 70/453, 454, 360, 361, DIG. 13, DIG. 25, 70/375, DIG. 62, 373, 345–349, 356, 372, 70/388, 421
See application file for complete search history.

(56) References Cited

U.S. PATENT DOCUMENTS 3,492,843 A * 2/1970 Slaybaugh ..... E05B 63/003 70/388
3,524,335 A * 8/1970 George ..... E05B 27/083 70/388
3,661,001 A * 5/1972 Glass ..... E05B 63/003 70/388
3,971,242 A * 7/1976 Mikos ..... E05B 63/0013 70/388
5,913,907 A * 6/1999 Lee ..... E05B 73/0005 248/551
2003/0226385 A1* 12/2003 Chin-Shen ..... E05B 27/083 70/491

(Continued)

*Primary Examiner* — Lloyd Gall
(74) *Attorney, Agent, or Firm* — Birch, Stewart, Kolasch & Birch, LLP

(57) ABSTRACT

A dual key lock core and a key lock core assembly using the same are provided. The dual key lock core of the present invention includes a lock core rod, a driving rod, and an outer barrel. The lock core rod includes a wedging part and an inner barrel disposed at opposite ends. The inner barrel has a hollow guiding groove, an inner barrel protrusion, and a first lock structure. The driving rod is rotatably capped within the inner barrel. One end of the outer surface of the driving rod has a driving protrusion. The other end of the outer surface of the driving rod has a second lock structure. The driving protrusion is in and movable along the hollow guiding groove when the driving rod is capped within the inner barrel.

11 Claims, 15 Drawing Sheets

(56) References Cited

U.S. PATENT DOCUMENTS

| | | | | |
|---|---|---|---|---|
| 2005/0160778 | A1* | 7/2005 | Leblond | E05B 15/022 70/491 |
| 2006/0081026 | A1* | 4/2006 | Lin | E05B 19/18 70/491 |
| 2008/0105014 | A1* | 5/2008 | Vickers | E05B 17/0025 70/404 |
| 2009/0199607 | A1* | 8/2009 | Huang | E05B 27/083 70/491 |

* cited by examiner

DUAL KEY LOCK CORE AND KEY LOCK CORE ASSEMBLY USING THE SAME

BACKGROUND OF THE INVENTION

1. Field of the Invention

The present invention generally relates to a key lock core and a key lock core assembly using the same.

2. Description of the Prior Art

For a long time, padlocks are widely used in various devices and products that need to be secured. The products, such as cabinets, suitcases, travel bags and any electronic devices, use padlocks to avoid unauthorized people to open and take out stuff from the products. Tourists normally put a padlock on the suitcase to avoid things contained in the suitcase from being stolen during air, sea or land transportation.

For safety reasons, the security check during transporting is more and more stringent. The baggage and suitcases used during travel are needed to pass several security checks, especially for the baggage transported by the airline. To check the baggage, the securities in the airport need to unlock the locks on the baggage. However, since different key cores are unlocked by different keys, the key unlocking process is time-consuming for baggage checking.

SUMMARY OF THE INVENTION

An object of the present invention is to provide a dual key lock core which can be rotated by two different keys.

Another object of the present invention is to provide a key lock core assembly.

The dual key lock core of the present invention includes a lock core rod, a driving rod, and an outer barrel. The lock core rod includes a wedging part and an inner barrel disposed at opposite ends. The inner barrel has a hollow guiding groove, an inner barrel protrusion and a first lock structure. The hollow guiding groove is disposed on a side wall of the inner barrel, wherein the hollow guiding groove including a straight portion extending along an axial direction of the lock core rod and an arc portion extending along a circumference of the inner barrel and communicating with the straight portion. The inner barrel protrusion is disposed on one end of an outer surface of the inner barrel near the wedging part. The first lock structure is disposed on an inner surface of the inner barrel near an opening of the inner barrel. The driving rod is rotatably capped within the inner barrel, the driving rod has a second lock structure on one end of an outer surface of the driving rod and a driving protrusion on the other end of the outer surface of the driving rod, wherein the driving protrusion is disposed in the hollow guiding groove and movable along the hollow guiding groove when the driving rod is capped within the inner barrel. The outer barrel has a first end and a second end opposite to the first end, wherein a portion of the first end retracts a first retracting distance to form a first indented part and another portion of the first end retracts a second retracting distance to form a second indented part, wherein the second indented part is connected to the first indented part, the first retracting distance of the first indented part is larger than the second retracting distance of the second indented part, the inner barrel is capped within the outer barrel with the first end facing the wedging part, the second lock structure is exposed by the second end of the outer barrel. When the dual key lock core is in a locked state, the driving protrusion protrudes out of the hollow guiding groove to be located at a place where the straight portion and the arc portion communicate to engage with one side of the first indented part adjacent to the second indented part, wherein the inner barrel protrusion engages with the other side of the first indented part opposite to the second indented part.

The key lock core assembly comprises the above dual key lock core and a first key. One end of the first key has a first barrel, the outer surface of the first barrel near the root of the first barrel has a first unlocking structure, the inner surface of the first barrel has a second unlocking structure, the first unlocking structure and the second unlocking structure respectively correspond to the first lock structure and the second lock structure, wherein the difference between the length of the first barrel and the length of the second lock structure along the axial direction of the driving rod is larger than or equal to the difference between the first retracting distance of the first indented part and the second retracting distance of the second indented part.

The key lock core assembly further comprises a second key. One end of the second key has a second barrel. The inner surface of the second barrel has the second unlocking structure. The outer diameter of the second barrel is smaller than the minimum inner diameter of the first lock structure, wherein the difference between the length of the second barrel and the length of the second lock structure along the axial direction of the driving rod is larger than or equal to the difference between the first retracting distance of the first indented part and the second retracting distance of the second indented part.

The first lock structure is a concave contour, wherein the first unlocking structure is a convex contour corresponding to the first lock structure. The second lock structure is a convex contour, wherein the second unlocking structure is a concave contour corresponding to the second lock structure.

In one embodiment, the inner barrel further includes a pin, wherein the pin protrudes toward the outer barrel from an opening end of the inner barrel and is capable of retreating into the inner barrel. The outer barrel further includes a circular restricting part circularly disposed on the second end, the inner surface of the circular restricting part has a first guiding groove, the first guiding groove extends into the side wall of the circular restricting part along the axial direction of the circular restricting part from one side of the circular restricting part near the second end. The movement of the pin toward one side of the circular restricting part opposite to the second end and the rotation of the inner barrel relative to the outer barrel are both restricted when a portion of the pin of the inner barrel extends into the first guiding groove. Regarding a key lock core assembly corresponding to this embodiment, the outer surface of the first barrel near the root of the first barrel further has an unlocking protrusion, wherein the unlocking protrusion corresponds to the first guiding groove. The height of the unlocking protrusion is larger than the length of the first guiding groove. The outer surface of the second barrel near the root of the second barrel has the unlocking protrusion.

The inner barrel further includes a concave and an elastic part. The concave is disposed on the edge face of the opening of the inner barrel. The pin is disposed in the concave. The elastic part is disposed between the pin and the bottom of the concave. The inner barrel further includes a second guiding groove and an elastic part. The second guiding groove is disposed on the inner surface of the inner barrel; the second groove extends to the edge face of the opening of the inner barrel along the axial direction of the inner barrel. The pin is disposed in the second guiding groove. The elastic part is disposed between the pin and the closing end of the second guiding groove.

DETAILED DESCRIPTION OF THE PREFERRED EMBODIMENT

Figure 1A:
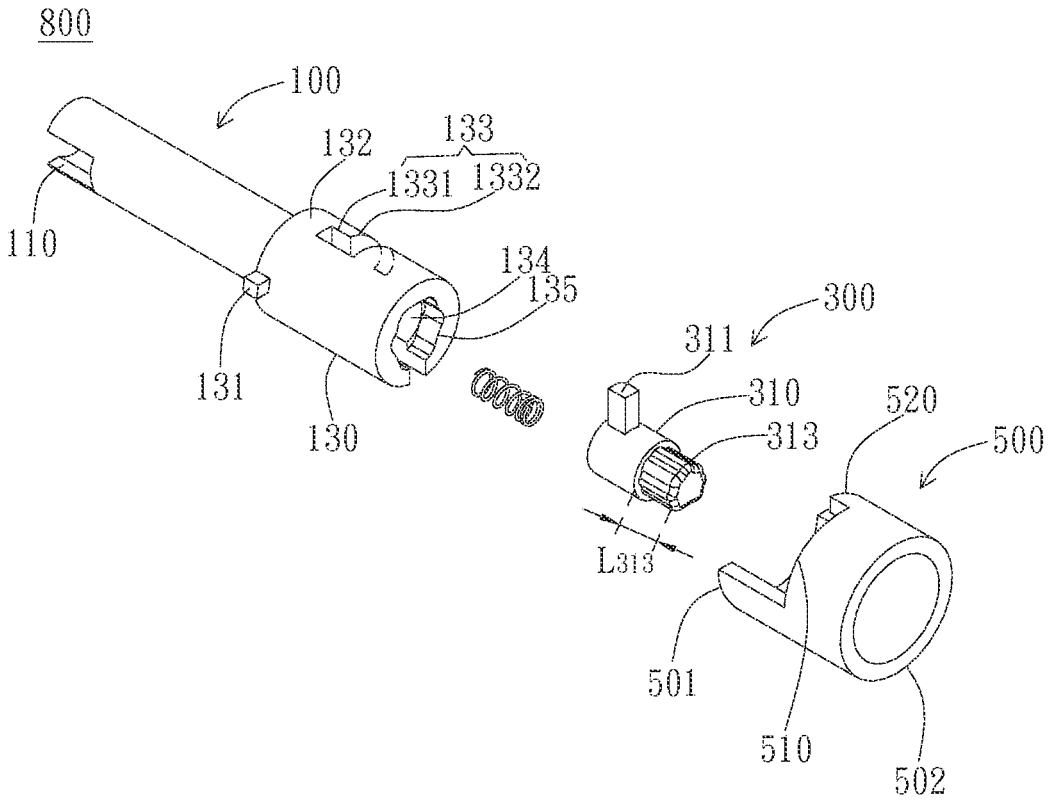
FIGS. 1A and 1B illustrate an embodiment of the present invention.
Figure 1B:
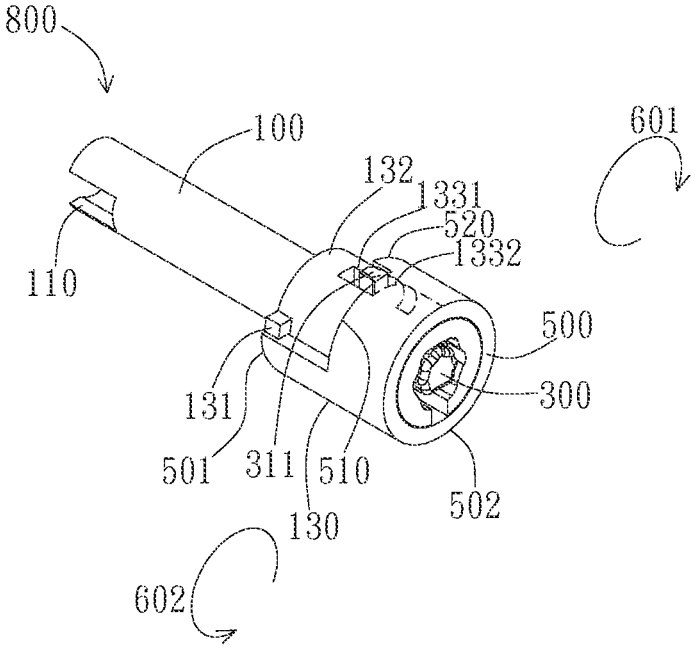

As the embodiments shown in FIGS. 1A and 1B, the dual key lock core 800 of the present invention includes a lock core rod 100, a driving rod 300, and an outer barrel 500. The lock core rod 100 includes a wedging part 110 and an inner barrel 130 disposed at opposite ends. The inner barrel 130 has a hollow guiding groove 133, an inner barrel protrusion 131, and a first lock structure 135. The hollow guiding groove 133 is formed on the side wall of the inner barrel 130. The hollow guiding groove 133 includes a straight portion 1331 extending along the axial direction of the lock core rod 100 and an arc portion 1332 extending along the circumference of the inner barrel 130 and communicating with the straight portion. The inner barrel protrusion 131 is disposed on one end of the outer surface 132 of the inner barrel 130 near the wedging part 110. The first lock structure 135 is disposed on the inner surface 134 of the inner barrel 130 near an opening of the inner barrel 130, wherein the opening is disposed on the other end of the inner barrel 130 opposite to the inner barrel protrusion 131.

The driving rod 300 is rotatably capped within the inner barrel 130. The driving rod 300 has a second lock structure 313 on one end of the outer surface 310 of the driving rod 300 and a driving protrusion 311 on the other end of the outer surface 310 of the driving rod 300. As shown in FIG. 1B, when the driving rod 300 is capped within the inner barrel 130, the driving protrusion 311 is disposed in the hollow guiding groove 133 and movable along the hollow guiding groove 133.

Figure 1C:
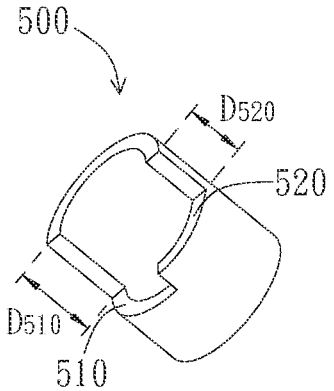
FIG. 1C illustrates an embodiment of the inner barrel in the present invention.

As shown in FIG. 1A and FIG. 1C, the outer barrel 500 has a first end 501 and a second end 502 opposite to the first end 501. A portion of the first end 501 retracts a first retracting distance $D_{510}$ to form a first indented part 510 and another portion of the first end 501 retracts a second retracting distance $D_{520}$ to form a second indented part 520, wherein the second indented part 520 is connected to the first indented part 510 and the first retracting distance $D_{510}$ of the first indented part 510 is larger than the second retracting distance $D_{520}$ of the second indented part 520. As shown in FIG. 1B, the inner barrel 130 is capped within the outer barrel 500 with the first end 501 facing the wedging part 110, wherein the second lock structure 313 is exposed by the second end 502 of the outer barrel 500. When the dual key lock core 800 is in a locked state, the driving protrusion 311 protrudes out of the hollow guiding groove 133 and is located at a place where the straight portion 1331 and the arc portion 1332 communicate to engage with one side of the first indented part 510 adjacent to the second indented part 520, wherein the inner barrel protrusion 131 engages with the other side of the first indented part 510 opposite to the second indented part 520.

More particularly, in the embodiment shown in FIG. 1B, with the inner barrel protrusion 131 engaging with the other side of the first indented part 510 opposite to the second indented part 520, the rotation of the inner barrel 130 and the lock core rod 100 relative to the outer barrel 500 along the direction 602 is restricted. In other words, the rotation of the driving rod 300 relative to the outer barrel 500 is restricted. On the other hand, with the driving protrusion 311 protruding out of the hollow guiding groove 133 and being located at the place where the straight portion 1331 and the arc portion 1332 communicate to engage with one side of the first indented part 510 adjacent to the second indented part 520, the rotation of the driving protrusion 311 along the direction 601 in the arc portion 1332 is restricted. As such, the rotation of the inner barrel 130 and the lock core rod 100 relative to the outer barrel 500 along the direction 601 is further restricted. Accordingly, the rotation of the driving rod 300 relative to the outer barrel 500 along the direction 601 is restricted. Therefore, when the dual key lock core 800 is in the locked state, the rotation of the driving rod 300 relative to the outer barrel 500 along the direction 601 and the direction 602 are both restricted, i.e. the driving rod 300 cannot rotate relative to the outer barrel 500.

As the embodiments shown in FIG. 2A to FIG. 6, the dual key lock core 800 can be unlocked by a first key 710. More particularly, the dual key lock core 800 and the first key 710 together can be seen as a key lock core assembly 900. As the embodiment shown in FIG. 2B, one end of the first key 710 has a first barrel 711. The outer surface of the first barrel 711 near the root of the first barrel has a first unlocking structure 210. The inner surface of the first barrel 711 has a second unlocking structure 220. The first unlocking structure 210 and the second unlocking structure 220 respectively correspond to the first lock structure 135 and the second lock structure 313, wherein the difference between the length $L_{711}$ of the first barrel 711 and the length $L_{313}$ of the second lock structure 313 along the axial direction of the driving rod 300 is larger than or equal to the difference between the first retracting distance $D_{510}$ of the first indented part 510 and the second retracting distance $D_{520}$ of the second indented part 520. In the preferred embodiment, the first lock structure 135 is a concave contour; the first unlocking structure 210 is a convex contour corresponding to the first lock structure 135. The second lock structure 313 is a convex contour; the second unlocking structure 220 is a concave contour corresponding to the second lock structure 220. The term "corresponding" here refers to the shape complementary of the contours on the section in the radial direction of the lock core rod 100. In other embodiments, however, it can refer to other engaging or embedding.

Figure 2A:
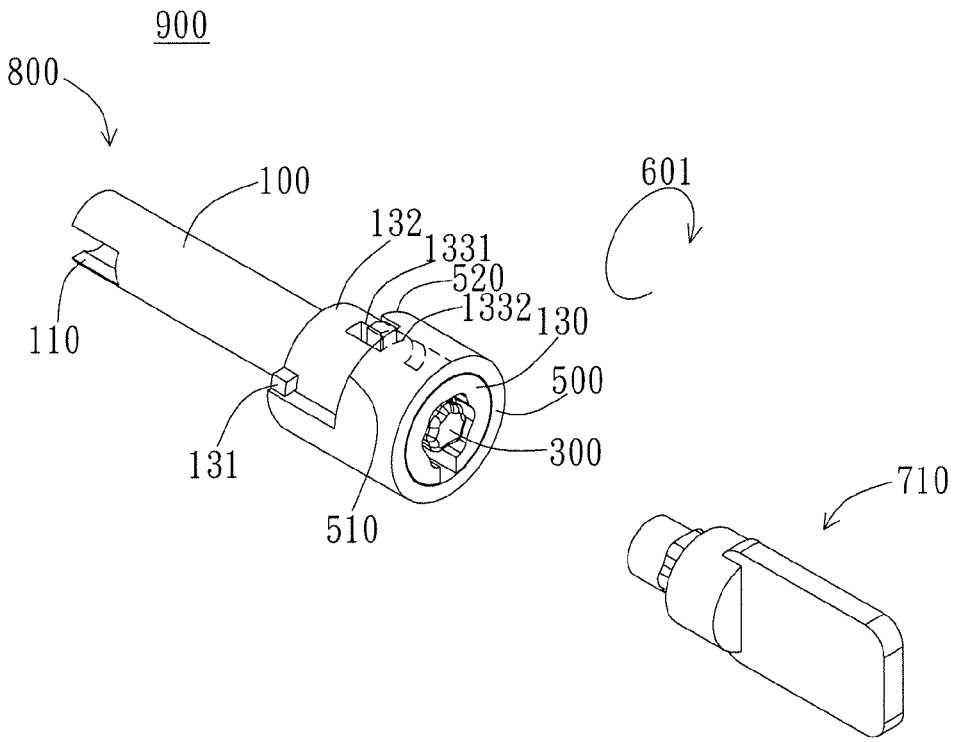
FIGS. 2A and 2B illustrate an embodiment of a dual key lock core of the present invention and the first key.
Figure 2B:
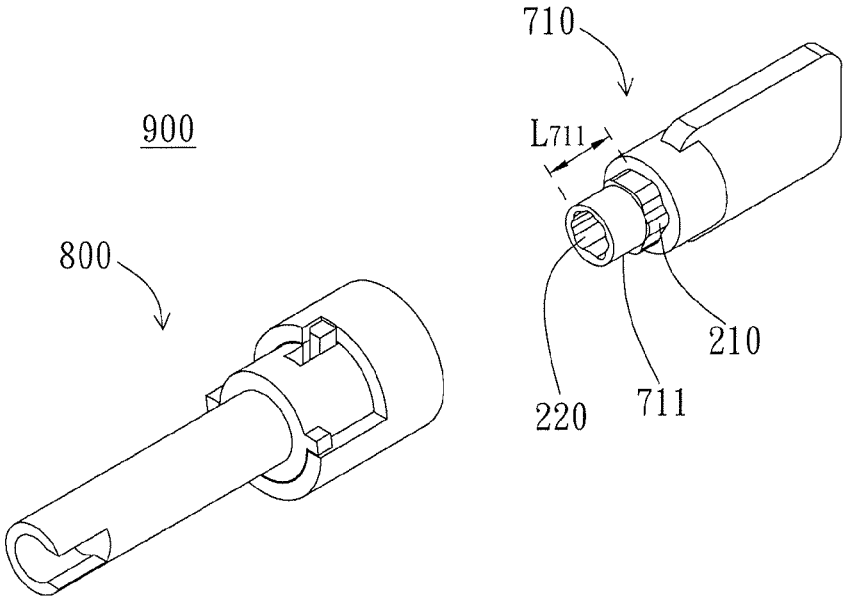
Figure 2C:
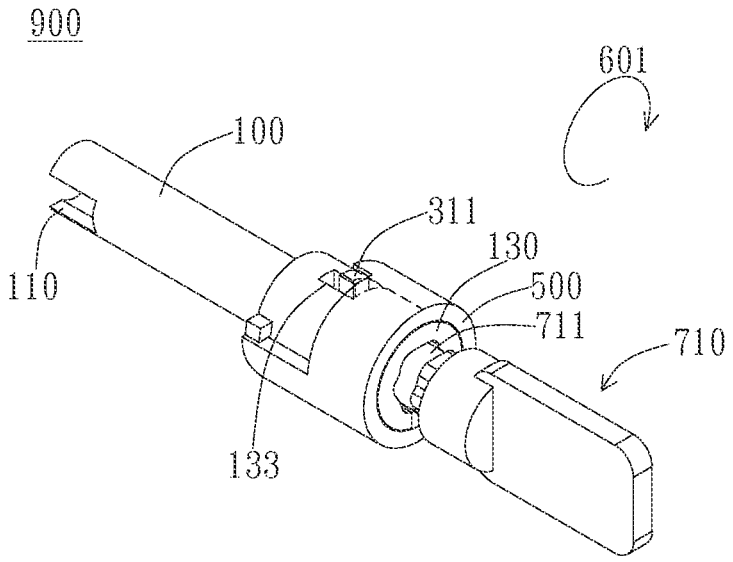
FIGS. 2C and 2D illustrate an embodiment of the present invention, wherein the first barrel of the first key is inserted into the inner barrel and pushes the driving rod.
Figure 2D:
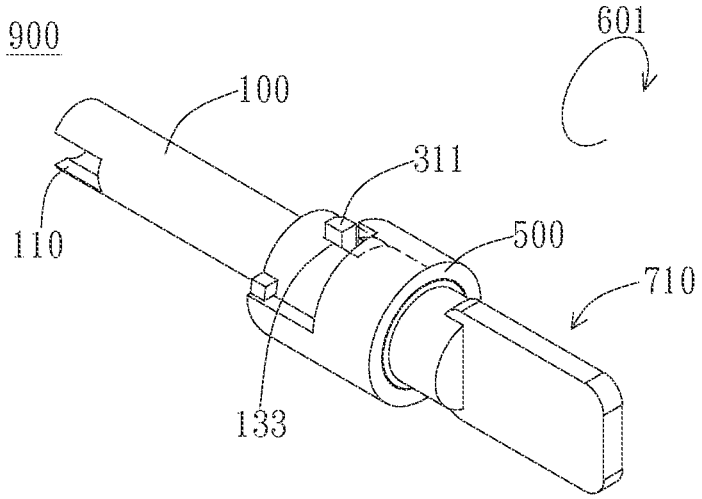
Figure 3:
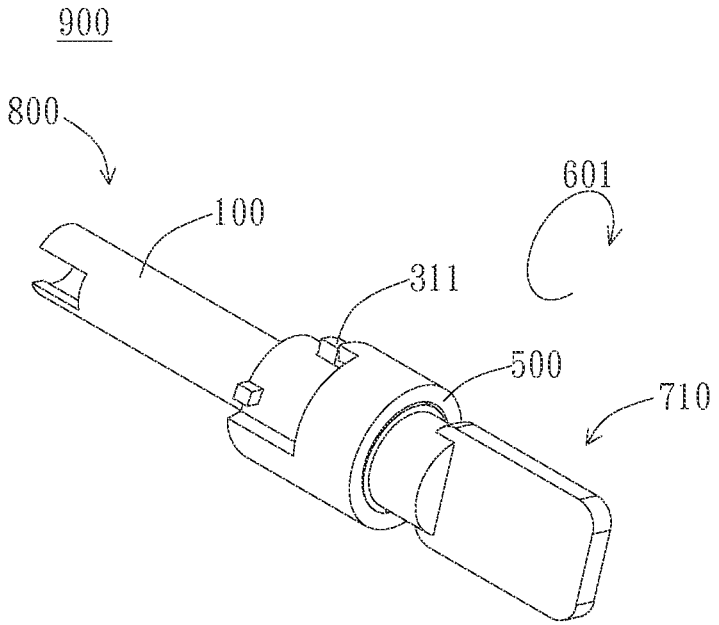
FIGS. 3-6 illustrate an embodiment of using the first key to unlock the dual key lock core of the present invention.
Figure 4:
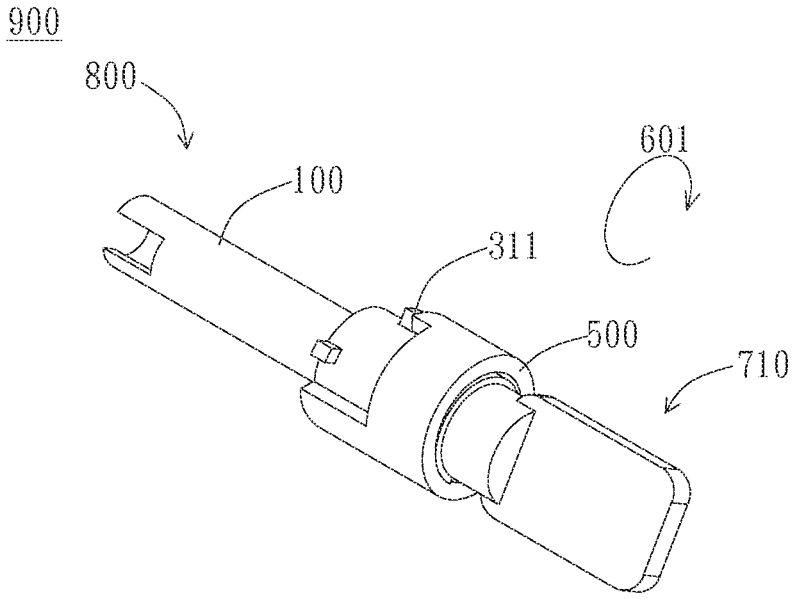
Figure 5:
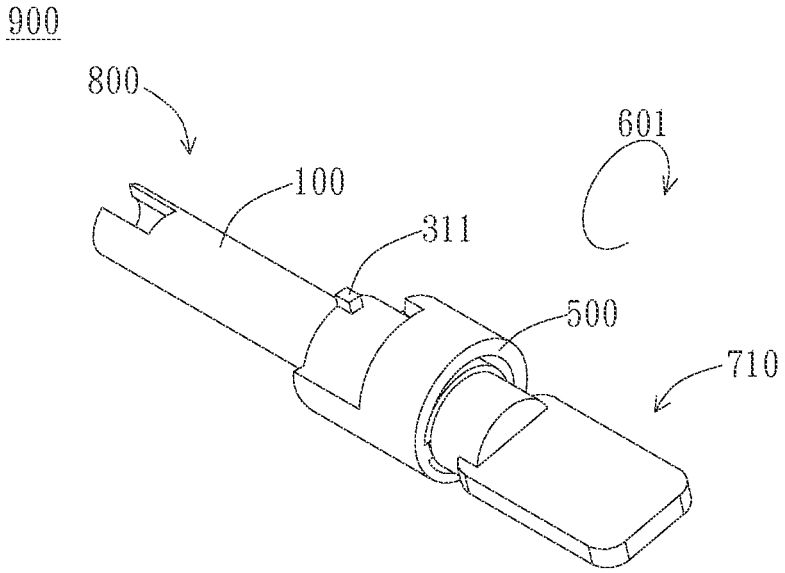
Figure 6:
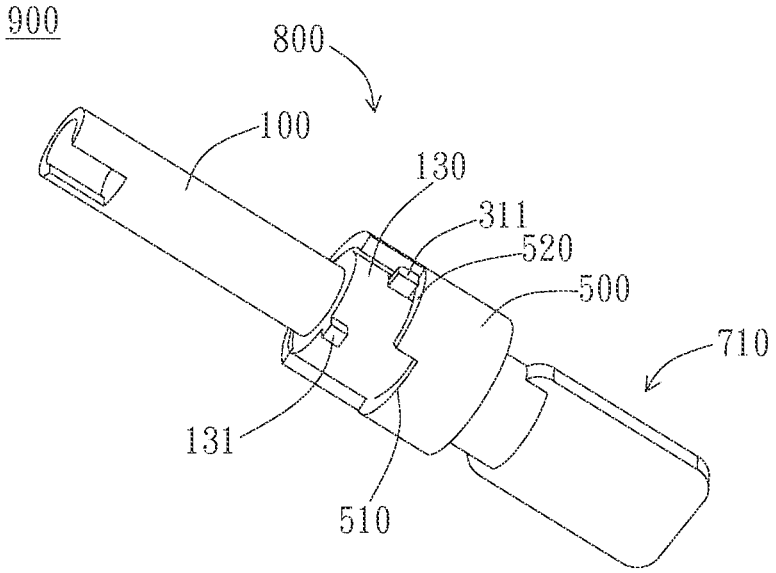

More particularly, since the first unlocking structure 210 and the second unlocking structure 220 respectively correspond to the first lock structure 135 and the second lock structure 313, and the difference between the length $L_{711}$ of the first barrel 711 and the length $L_{313}$ of the second lock structure 313 along the axial direction of the driving rod 300 is larger than or equal to the difference between the first retracting distance $D_{510}$ of the first indented part 510 and the second retracting distance $D_{520}$ of the second indented part 520, the first barrel 711 can be inserted into the inner barrel 130 and pushes the driving rod 300 (see FIG. 2A) and the driving protrusion 311 to move toward the wedging part 110 along the straight portion 1331, as shown in FIGS. 2C and 2D. Therefore, the restriction to the rotation of the driving protrusion 311 relative to the outer barrel along the direction 601 is released, i.e. the restriction to the rotation of the driving rod 300 relative to the outer barrel along the direction 601 is released. Then, as shown in FIGS. 3-6, when the first key 710 rotates along the direction 601, the driving protrusion 311 engages with the side wall of the straight portion 1331 and drives the lock core rod 100 to rotate along the direction 601 to unlock the lock (not shown) having the dual key lock core 800.

As the embodiments shown in FIG. 7A to FIG. 10, the dual key lock core 800 can also be unlocked by a second key 720. More particularly, the key lock core assembly 900 includes the dual key lock core 800, the first key 710, and the second key 720. As the embodiments shown in FIGS. 7A and 7B, one end of the second key 720 has a second barrel 721. The inner surface of the second barrel 721 has the second unlocking structure 220. The outer diameter R721 of the second barrel 721 is smaller than the minimum inner diameter of the first lock structure 135, wherein the difference between the length L721 of the second barrel 721 and the length of the second lock structure 135 along the axial direction of the driving rod 300 is larger than or equal to the difference between the first retracting distance D510 of the first indented part 510 and the second retracting distance D520 of the second indented part 520.

Figure 7A:
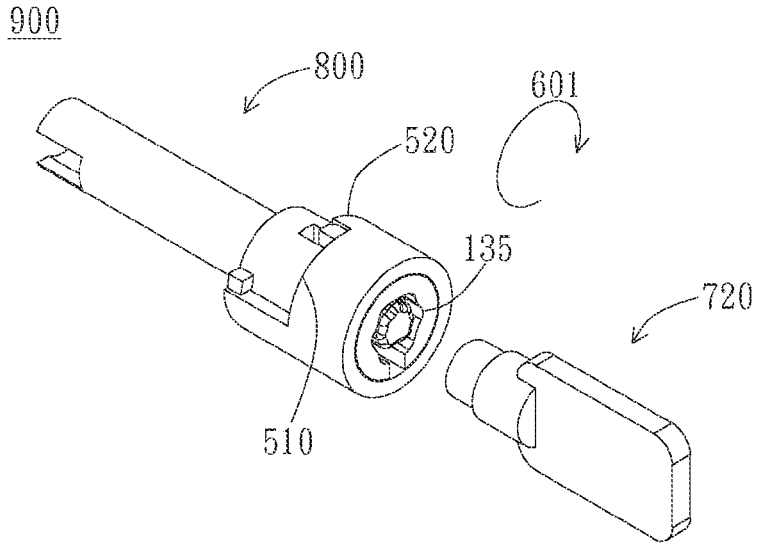
FIGS. 7A and 7B illustrate an embodiment of a dual key lock core of the present invention and the second key.
Figure 7B:
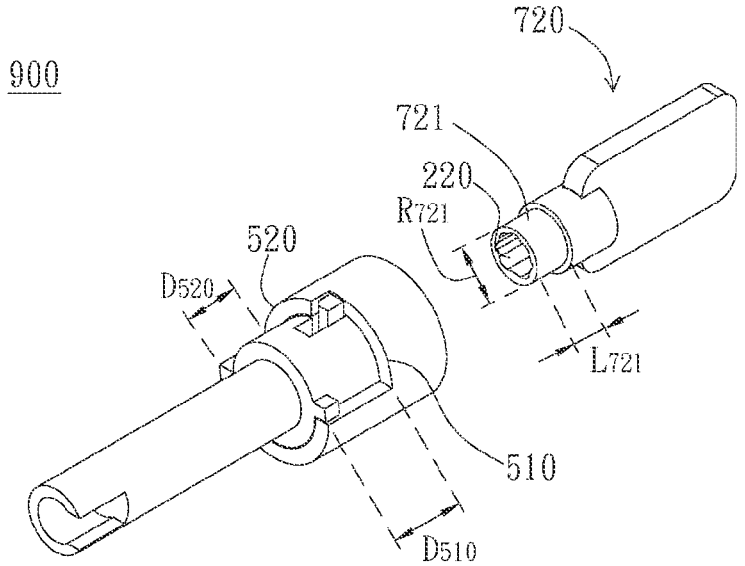
Figure 7C:
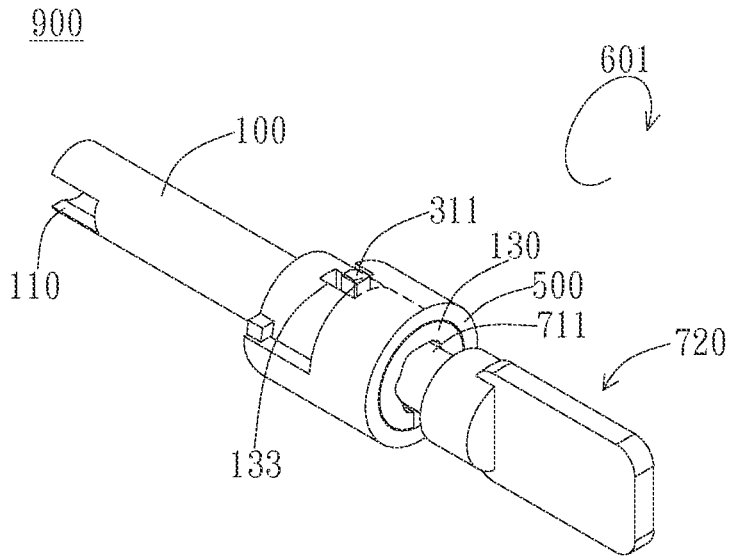
FIGS. 7C and 7D illustrate an embodiment of the present invention, wherein the second barrel of the second key is inserted into the inner barrel and pushes the driving rod.
Figure 7D:
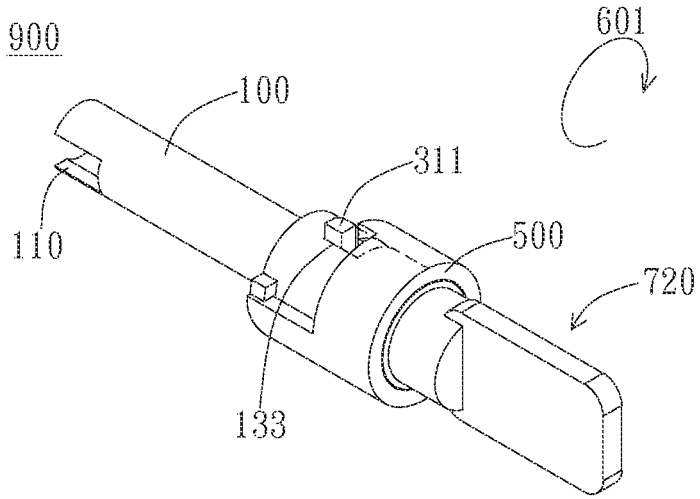
Figure 8:
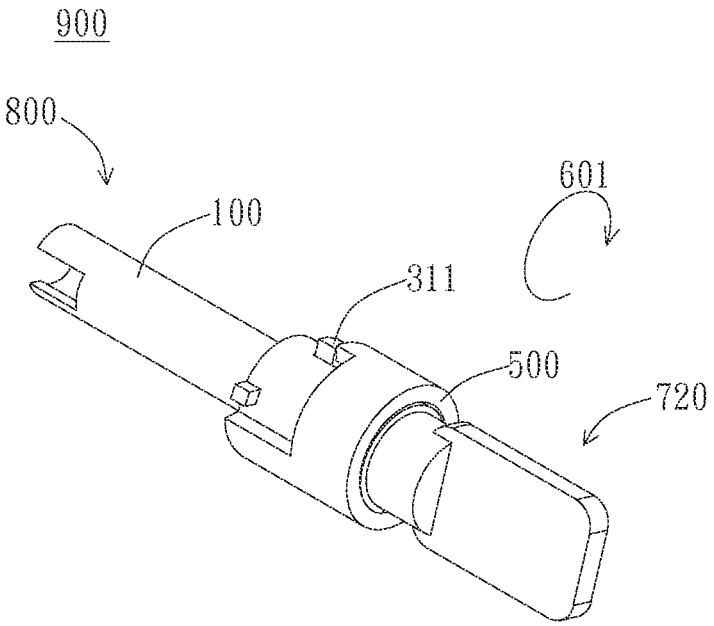
FIGS. 8-11 illustrate an embodiment of using the second key to unlock the dual key lock core of the present invention.
Figure 9:
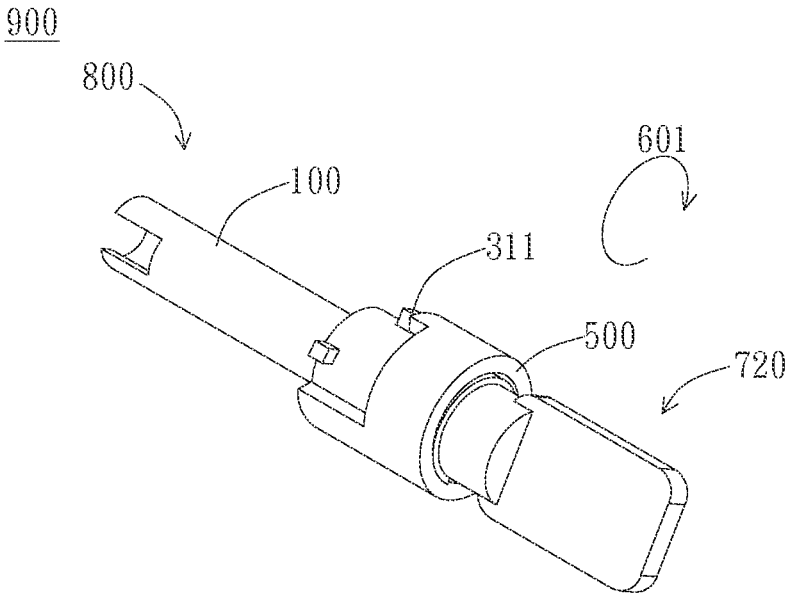
Figure 10:
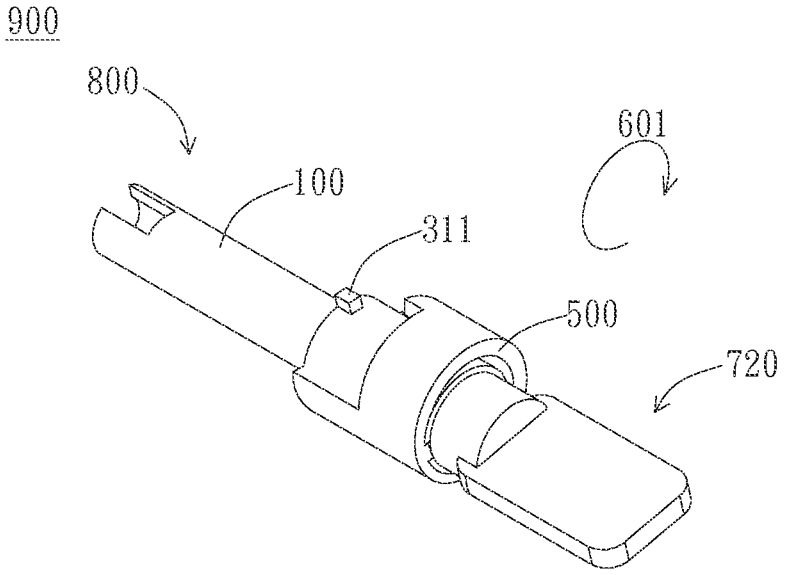
Figure 11:
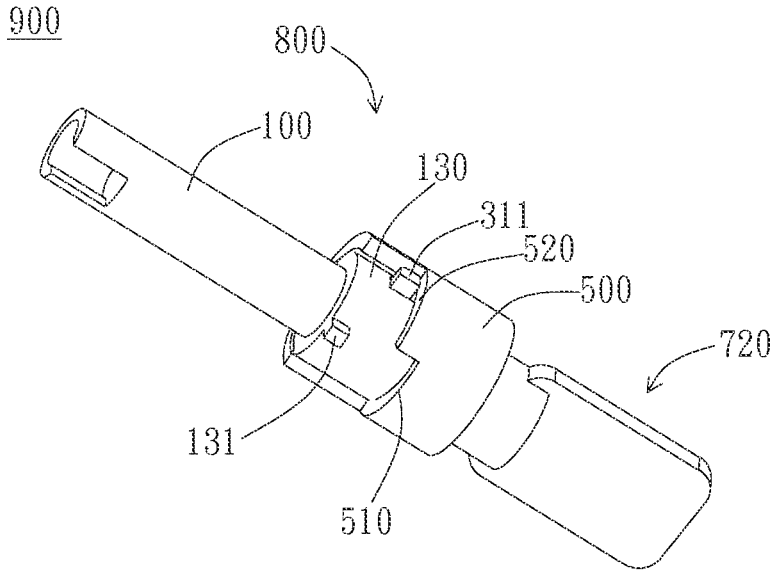

Since the second unlocking structure 220 corresponds to the second lock structure 313, wherein the outer diameter $R_{721}$ of the second barrel 721 is smaller than the minimum inner diameter of the first lock structure 135 and the difference between the length $L_{721}$ of the second barrel 721 and the length of the second lock structure 135 along the axial direction of the driving rod 300 is larger than or equal to the difference between the first retracting distance $D_{510}$ of the first indented part 510 and the second retracting distance $D_{520}$ of the second indented part 520, the second barrel 721 can be inserted into the inner barrel 130 and pushes the driving rod 300 (see FIG. 2A) and the driving protrusion 311 to move toward the wedging part 110 along the straight portion 1331, as shown in FIGS. 7C and 7D. Therefore, the restriction to the rotation of the driving protrusion 311 relative to the outer barrel along the direction 601 is released, i.e. the restriction to the rotation of the driving rod 300 relative to the outer barrel along the direction 601 is released. Then, as shown in FIGS. 8-11, when the second key 720 rotates along the direction 601, the driving protrusion 311 engages with the side wall of the straight portion 1331 and drives the lock core rod 100 to rotate along the direction 601 to unlock the lock (not shown) having the dual key lock core 800.

It can be seen in the embodiments described above that locks having the dual key lock core 800 of the present invention can be unlocked by two different keys. Therefore the convenience in use can be increased. For example, when the dual key lock core 800 of the present invention is used in suitcase locks, different first lock structures 135 and same second lock structures 313 are equipped. The keys obtained by the customers when they purchase the suitcase are the "first keys 710" having the same second unlocking structure 220 and different first unlocking structures 210. Therefore, each customer only can unlock his own suitcase by the key he obtained. The keys provided to the securities are the "second keys 720" having the same second unlocking structure 220 with the customers' and are free from blocking of the first lock structures 135 when inserting into the dual key lock cores 800. Therefore, the keys provided to the securities are allowed to unlock every lock using the dual key lock cores 800.

In different embodiments, the dual key lock core 800 further includes a pin to increase a restriction to the rotation of the lock core rod 100 relative to the outer barrel 500. As the embodiments shown in FIGS. 12A and 12B, the inner barrel 130 further includes a pin 137. The pin 137 protrudes toward the outer barrel 500 from an opening end of the inner barrel 130 and is capable of retreating into the inner barrel 130. The outer barrel 500 further includes a circular restricting part 570 circularly disposed on the second end 502. The inner surface 571 of the circular restricting part 570 has a first guiding groove 573. The first guiding groove 573 extends into the side wall of the circular restricting part 570 along the axial direction of the circular restricting part 570 from one side of the circular restricting part 570 near the second end 502. The movement of the pin 137 toward one side of the circular restricting part 570 opposite to the second end 502 and the rotation of the inner barrel 130 relative to the outer barrel 500 are both restricted when a portion of the pin 137 of the inner barrel 130 extends into the first guiding groove 573. Corresponding to a key lock core assembly 900 of this embodiment, the outer surface of the first barrel 711 near the root of the first barrel 711 further has an unlocking protrusion 717, wherein the unlocking protrusion 717 corresponds to the first guiding groove 573. The height $H_{717}$ of the unlocking protrusion 717 is larger than the length of the first guiding groove 573. As an embodiment shown in FIG. 12C, the key lock core assembly 900 includes the second key 720, the outer surface of the second barrel 721 near the root of the second barrel 721 has the unlocking protrusion 717.

Figure 12A:
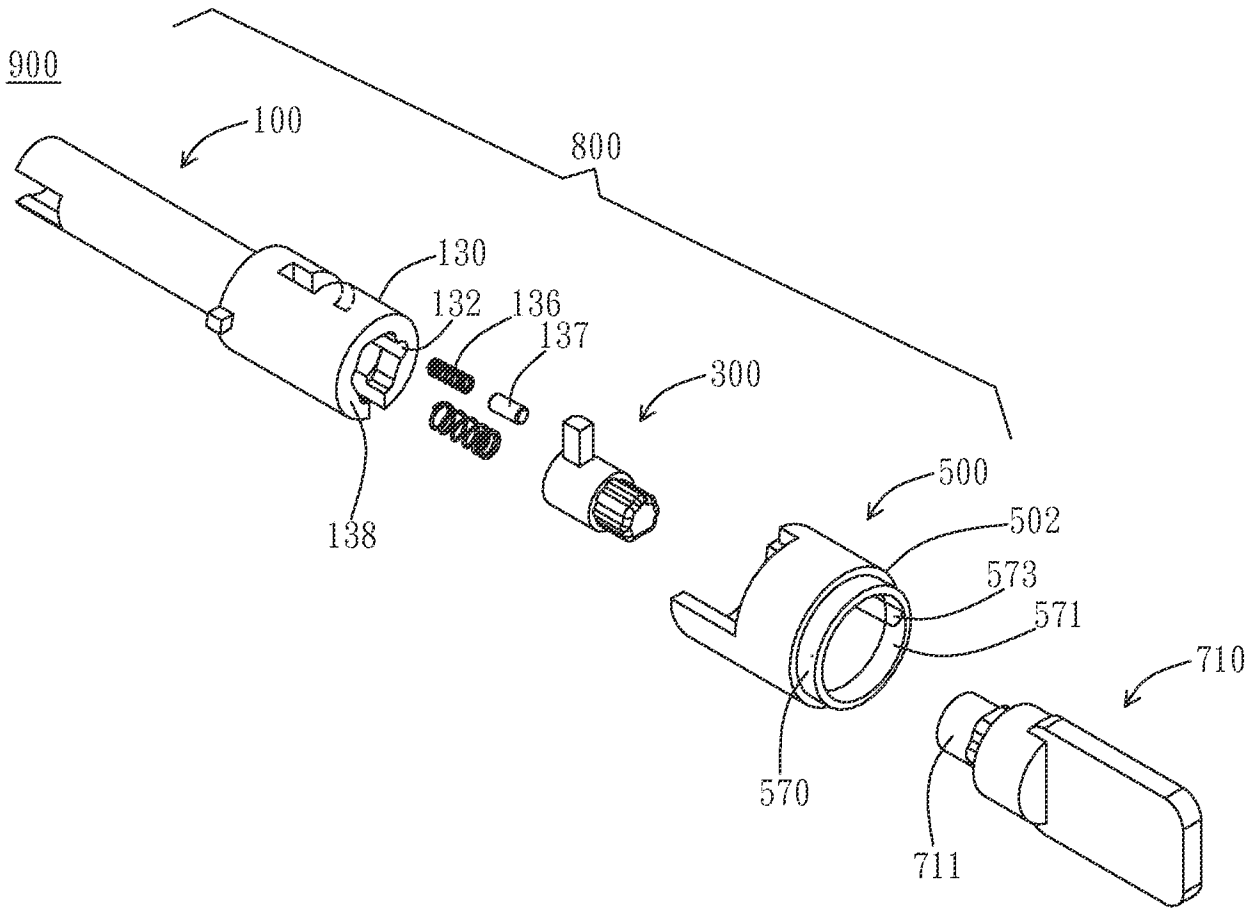
FIGS. 12A-12C illustrate an embodiment of a dual key lock core of the present invention further including the pin.
Figure 12B:
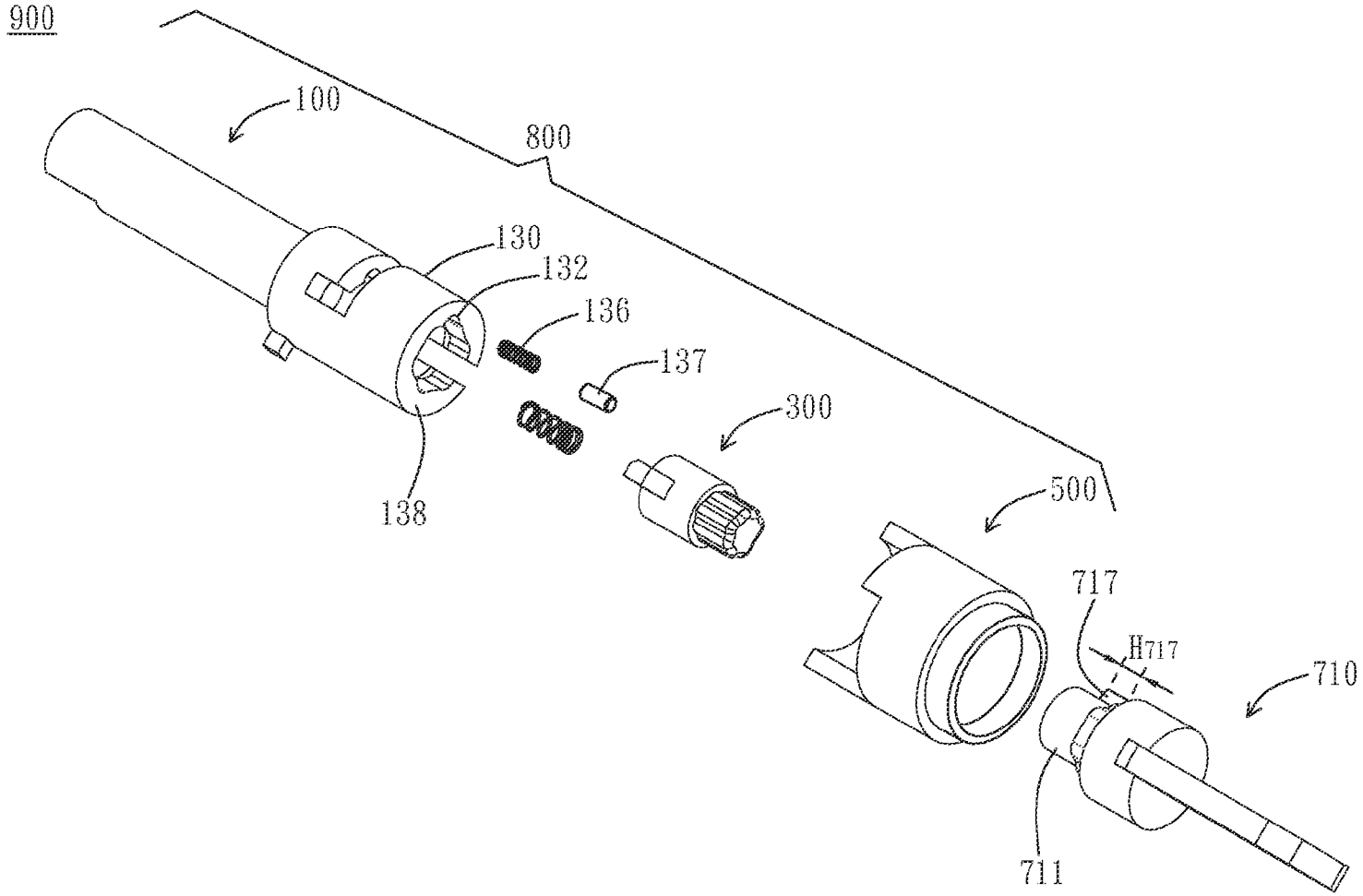
Figure 12C:
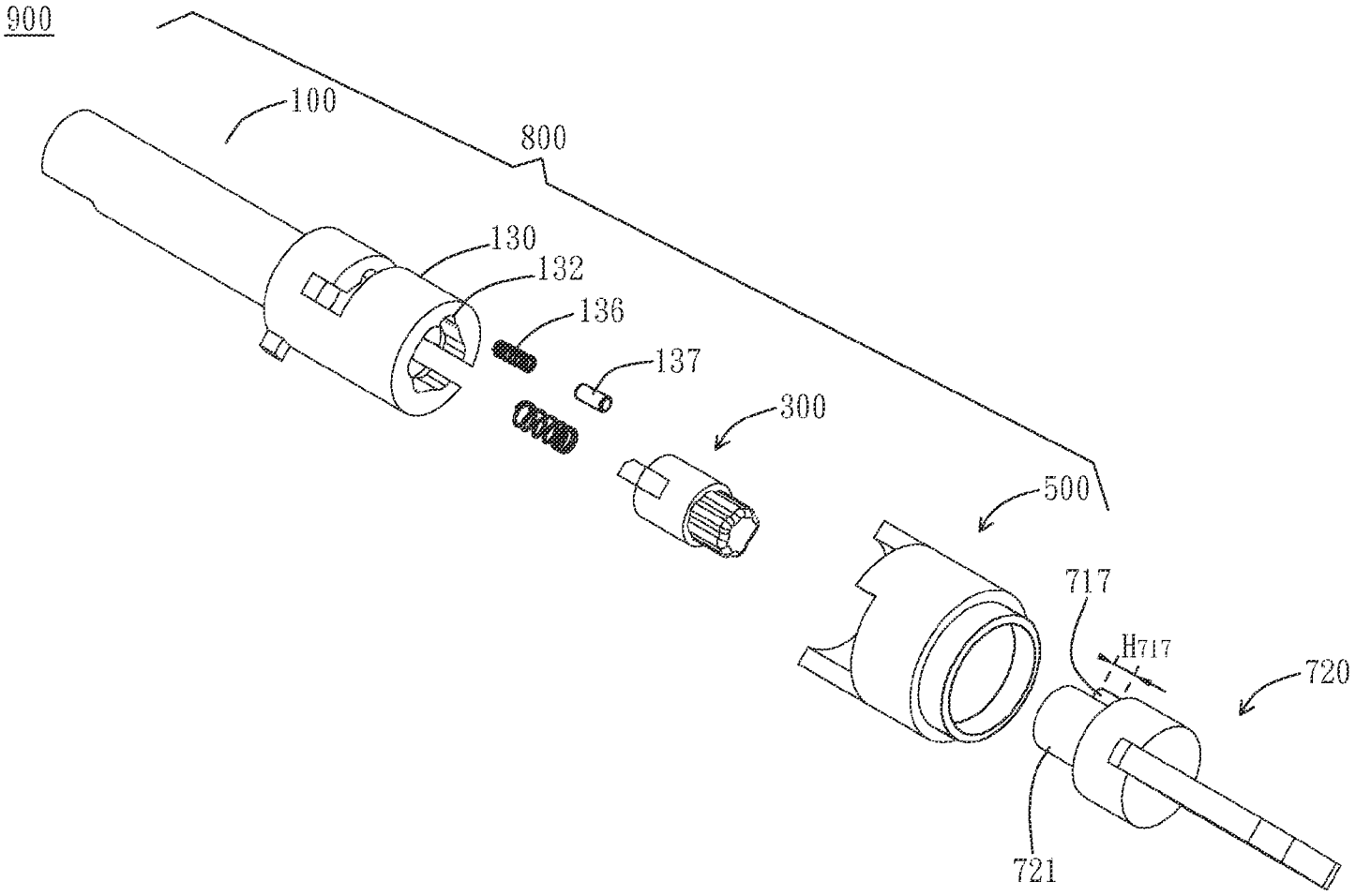
Figure 13A:
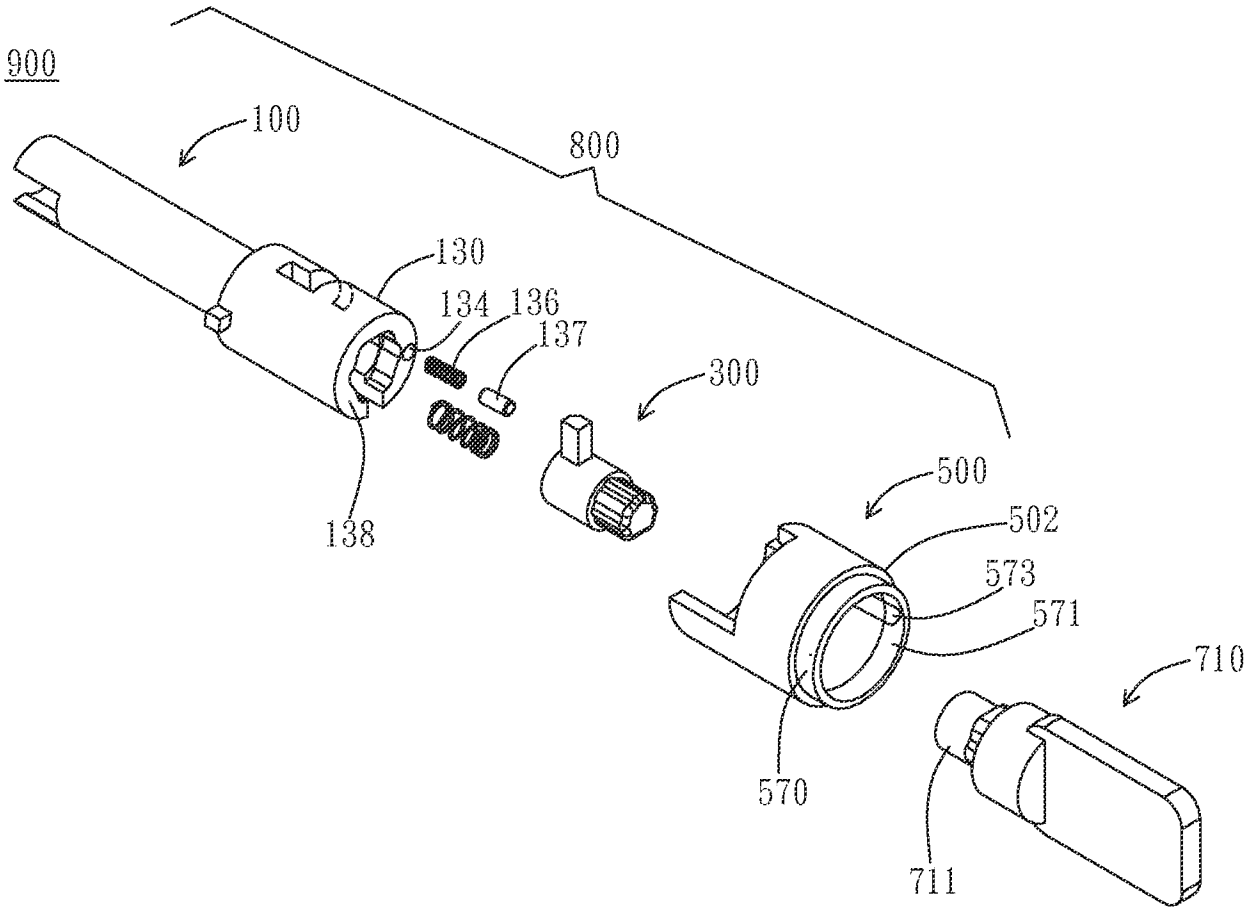
FIGS. 13A-13B illustrate another embodiment of a dual key lock core of the present invention further including the pin.
Figure 13B:
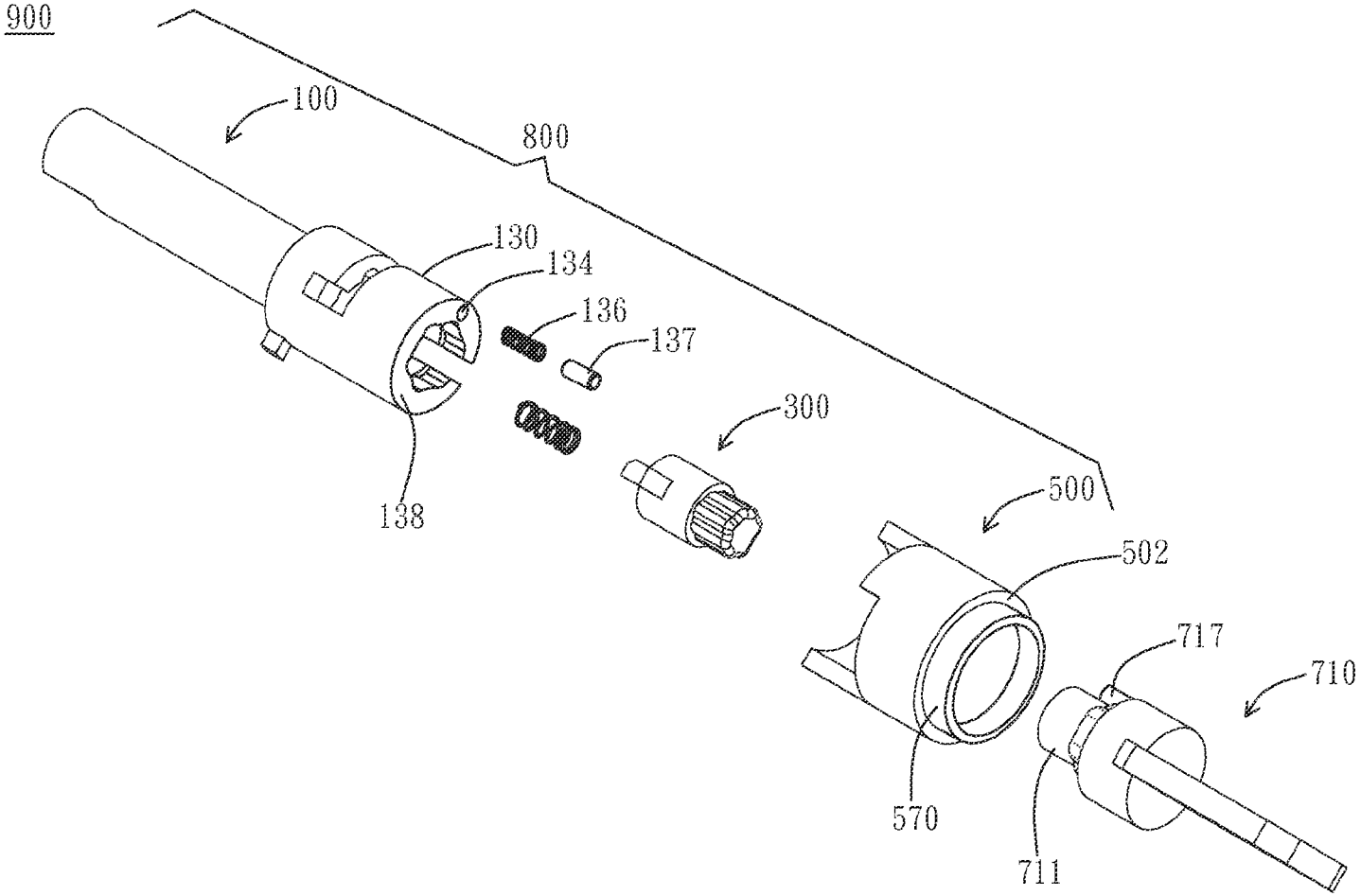

More particularly, in the embodiments shown in FIGS. 12A-12C, the inner barrel 130 further includes a second guiding groove 132 and an elastic part 136. The second guiding groove 132 is disposed on the inner surface of the inner barrel 130. The second guiding groove 132 extends to the edge face 138 of the opening of the inner barrel 130 along the axial direction of the inner barrel 130. The pin 137 is disposed in the second guiding groove 132. In the embodiments shown in FIGS. 13A-13B, the inner barrel 130 further includes a concave 134 and an elastic part 136. The concave 134 is disposed on the edge face 138 of the opening of the inner barrel 130. The pin 137 is disposed in the concave 134. The elastic part 136 is disposed between the pin 137 and the bottom of the concave 134.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A dual key lock core, comprising:

a lock core rod including a wedging part and an inner barrel disposed at opposite ends, wherein a first lock structure is disposed on an inner surface of the inner barrel near an opening of the inner barrel;

a driving rod rotatably capped within the inner barrel, the driving rod has a second lock structure disposed on one end of an outer surface of the driving rod; and an outer barrel having a first end and a second end opposite to the first end, the second lock structure is exposed by the second end of the outer barrel;

when the dual key lock core is in a locked state, the lock core rod and the driving rod engage with the outer barrel, the rotation of the lock core rod and the driving rod relative to the outer barrel are restricted;

when the driving rod moves toward the wedging part, the restriction to the rotation of the driving rod and the lock core rod relative to the outer barrel are released.

2. The dual key lock core of claim 1, wherein:

the inner barrel further includes:

a hollow guiding groove on a side wall of the inner barrel, the hollow guiding groove including a straight portion extending along an axial direction of the lock core rod and an arc portion extending along a circumference of the inner barrel and communicating with the straight portion; and an inner barrel protrusion on one end of an outer surface of the inner barrel near the wedging part;

the driving rod further has a driving protrusion disposed on the other end of the outer surface of the driving rod, wherein the driving protrusion is disposed in the hollow guiding groove and movable along the hollow guiding groove when the driving rod is capped within the inner barrel;

a portion of the first end retracts a first retracting distance to form a first indented part and another portion of the first end retracts a second retracting distance to form a second indented part, wherein the second indented part is connected to the first indented part, the first retracting distance of the first indented part is larger than the second retracting distance of the second indented part, the inner barrel is capped within the outer barrel with the first end facing the wedging part;

when the dual key lock core is in the locked state, the driving protrusion protrudes out of the hollow guiding groove to be located at a place where the straight portion and the arc portion communicate to engage with one side of the first indented part adjacent to the second indented part, wherein the inner barrel protrusion engages with the other side of the first indented part opposite to the second indented part.

3. The dual key lock core of claim 2, wherein:

the inner barrel further includes a pin, the pin protrudes toward the outer barrel from an opening end of the inner barrel and is capable of retreating into the inner barrel;

the outer barrel further includes a circular restricting part circularly disposed on the second end, the inner surface of the circular restricting part has a first guiding groove, the first guiding groove extends into the side wall of the circular restricting part along the axial direction of the circular restricting part from one side of the circular restricting part near the second end;

wherein the movement of the pin toward one side of the circular restricting part opposite to the second end and the rotation of the inner barrel relative to the outer barrel are both restricted when a portion of the pin of the inner barrel extends into the first guiding groove.

4. The dual key lock core of claim 3, wherein the inner barrel further includes:

a concave disposed on the edge face of the opening of the inner barrel, the pin is disposed in the concave; and an elastic part disposed between the pin and the bottom of the concave.

5. The dual key lock core of claim 3, wherein the inner barrel further includes:

a second guiding groove disposed on the inner surface of the inner barrel, the second guiding groove extends to the edge face of the opening of the inner barrel along the axial direction of the inner barrel, the pin is disposed in the second guiding groove; and an elastic part disposed between the pin and the closing end of the second guiding groove.

6. A key lock core assembly, comprising:

the dual key lock core of claim 2; and a first key, wherein one end of the first key has a first barrel, the outer surface of the first barrel near the root of the first barrel has a first unlocking structure, the inner surface of the first barrel has a second unlocking structure, the first unlocking structure and the second unlocking structure respectively correspond to the first lock structure and the second lock structure, wherein the difference between the length of the first barrel and the length of the second lock structure along the axial direction of the driving rod is larger than or equal to the difference between the first retracting distance of the first indented part and the second retracting distance of the second indented part.

7. The key lock core assembly of claim 6, further comprising a second key, wherein one end of the second key has a second barrel, the inner surface of the second barrel has the second unlocking structure, the outer diameter of the second barrel is smaller than the minimum inner diameter of the first lock structure, wherein the difference between the length of the second barrel and the length of the second lock structure along the axial direction of the driving rod is larger than or equal to the difference between the first retracting distance of the first indented part and the second retracting distance of the second indented part.

8. The key lock core assembly of claim 6, wherein the first lock structure is a concave contour, the first unlocking structure is a convex contour corresponding to the first lock structure; and the second lock structure is a convex contour, the second unlocking structure is a concave contour corresponding to the second lock structure.

9. A key lock core assembly, comprising:

the dual key lock core of claim 3; and a first key, wherein one end of the first key has a first barrel, the outer surface of the first barrel near the root of the first barrel has a first unlocking structure and an unlocking protrusion, the inner surface of the first barrel has a second unlocking structure, the first unlocking structure corresponds to the first lock structure, the unlocking protrusion corresponds to the first guiding groove, the height of the unlocking protrusion is larger than the length of the first guiding groove, the second unlocking structure corresponds to the second lock structure, wherein the difference between the length of the first barrel and the length of the second lock structure along the axial direction of the driving rod is larger than or equal to the difference between the first retracting distance of the first indented part and the second retracting distance of the second indented part.

10. The key lock core assembly of claim 9, further comprising a second key, wherein one end of the second key has a second barrel, the outer surface of the second barrel near the root of the second barrel has the unlocking protrusion, the inner surface of the second barrel has the second unlocking structure, the outer diameter of the second barrel is smaller than the minimum inner diameter of the first lock structure, wherein the difference between the length of the second barrel and the length of the second lock structure along the axial direction of the driving rod is larger than or equal to the difference between the first retracting distance of the first indented part and the second retracting distance of the second indented part.

11. The key lock core assembly of claim 10, wherein the first lock structure is a concave contour, the first unlocking structure is a convex contour corresponding to the first lock structure; and the second lock structure is a convex contour, the second unlocking structure is a concave contour corresponding to the second lock structure.

* * * * *